US005242019A

United States Patent [19]

Benker

[11] Patent Number: 5,242,019

[45] Date of Patent: Sep. 7, 1993

[54] DOWNHOLE TOOL WITH INCREASED FRICTION SURFACE AND METHOD OF MANUFACTURE

[75] Inventor: Wilhelm E. Benker, Houston, Tex.

[73] Assignee: Baker Hughes Incorporated, Houston, Tex.

[21] Appl. No.: 884,829

[22] Filed: May 18, 1992

[51] Int. Cl.[5] ..... E21B 33/127

[52] U.S. Cl. ..... 166/187; 166/212

[58] Field of Search ..... 166/187, 212, 51, 134; 16/DIG. 12; 273/75, 81.5; 403/263; 81/177.1

[56] References Cited

U.S. PATENT DOCUMENTS

| | | | |
|---|---|---|---|
| 1,384,305 | 7/1921 | Crotto | 166/187 |
| 1,802,525 | 4/1931 | Newlin | 166/187 |
| 2,178,844 | 11/1939 | Baker | 166/187 |
| 2,187,635 | 1/1940 | Stamps | 166/187 |
| 2,275,936 | 3/1942 | Baker | 166/187 |
| 2,446,622 | 8/1948 | Turner | 16/DIG. 12 |
| 3,085,627 | 4/1963 | Sodich | 166/212 |
| 3,972,528 | 8/1976 | McCracken et al. | 273/75 |
| 4,159,115 | 6/1979 | Ticktin et al. | 273/81.5 |
| 4,607,698 | 8/1986 | Wood . | |
| 4,744,421 | 5/1988 | Wood et al. . | |
| 4,871,179 | 10/1989 | Bell et al. . | |

*Primary Examiner*—Ramon S. Britts
*Assistant Examiner*—Frank S. Tsay
*Attorney, Agent, or Firm*—Charles D. Gunter, Jr.

[57] ABSTRACT

An inflatable packer is shown which includes a tubular mandrel and an inflatable, elastomeric sleeve secured to the mandrel at opposing ends thereof. A friction enhancing media is applied to the exterior surface of the mandrel by wrapping a grit laden tape about the mandrel exterior surface. The particulate material contained within the outer surface of the tape increases the coefficient of friction between the mandrel and the sleeve to retain the sleeve in its original position while the device is being run into position within the well bore.

10 Claims, 2 Drawing Sheets

DOWNHOLE TOOL WITH INCREASED FRICTION SURFACE AND METHOD OF MANUFACTURE

BACKGROUND OF THE INVENTION

1. Field of the Invention

The present invention relates generally to downhole completion and production devices for use in oil and gas wells and, more specifically, to an inflatable packer having an inflatable elastomeric sleeve carried on a metallic mandrel, the mandrel having an improved means for increasing the friction between the outer metallic surface thereof and the inflatable elastomeric sleeve.

2. Description of the Prior Art

Various downhole devices employ elastomeric components which move either axially or radially relative to a cooperating external metallic surface during completion and production operations. One example is the inflatable packer which includes a tubular mandrel covered by an inflatable elastomeric sleeve secured to the mandrel by a pair of axially spaced-apart rings. The elastomeric sleeve is normally reinforced by a reinforcing sheath, which includes a plurality of overlapping ribs connected between the rings. Valve means are provided in order to allow inflating fluid to pass between the exterior of the metallic mandrel and the internal surface of the elastomeric sleeve in order to inflate the sleeve into sealing contact with the well bore or casing. The LYNES unique inflatable elements have been recognized for over three decades in unique inflatable element designs. These products include the external casing packer, the production-injection packer and the inflatable drill stem test tools, all of which are based upon inflatable packer technology.

Typically, such inflatable packers isolate the annulus above the packer from the annulus below the packer and are only required to be of a length long enough to form an effective seal. In other cases, inflatable packers are used in well completion, including those packers adapted to be positioned adjacent the producing zone and inflated with cement. After the cement has set, the packer is perforated and the well is produced through the packer. Packers of this type tend to be many feet in length, i.e., from 10 to 40 feet or more in length, in order to seal against both the producing formation which is perforated and the formations above and below the producing formation. An example of a known inflatable packer of the above type is the LYNES XL ECP packer available from Baker Service Tools, a division of Baker Hughes Incorporated, Houston, Tex.

Thus, completion type inflatable packers of the above design are of a much greater length than the typical inflatable packer used in, e.g., drill stem testing. The central portion of the inflatable, elastomeric element of such packers is supported and reinforced by the bore hole. As a result, a reinforcing sheath is unnecessary in the central part of the inflatable elastomeric element. However, reinforcement is generally required at the ends of the inflatable elastomeric element in order to prevent the elastomeric sleeve from extruding past the attachment collars. As a result, the elastomeric sleeves of the completion type packers have previously been reinforced only at the ends adjacent the attachment collars.

One problem encountered with the prior art designs involves the running-in operation in which the inflatable packer is run into the desired location within the well bore. At times, the elastomeric sleeve contacts the bore-hole wall. This possibility of contact is particularly acute in the case of deviated well bores. As the elastomeric sleeve contacts the well bore during the insertion operation, frictional force is applied to the elastomeric sleeve, tending to move the sleeve with respect to the metallic mandrel. In the case of a short length inflatable packer with continuous reinforcing sheaths, the reinforcing sheath provides adequate stiffness to prevent axial movement due to frictional contact with the surrounding well bore. In the case of completion type packers of the type described above, where the elastomeric sleeve is 10 to 40 feet or more in length, the coefficient of friction between the surrounding well bore and sleeve typically exceeds the coefficient of friction between the elastomeric element and the metallic mandrel. As a result, the elastomeric sleeve can move with respect to the mandrel. This movement can cause thickening of the sleeve at the upper end of the inflatable packer and can deform outwardly the upper reinforcing material. In some cases, the movement of the sleeve along the mandrel can cause the diameter of the packer to become greater than that of the surrounding well bore, causing the packer to become stuck in one location.

U.S. Pat. No. 4,311,314 shows an inflatable packer having an inflatable sleeve mounted on a tubular mandrel that is covered with a gritty, material. The grit particles are bonded to the outer surface of the mandrel by a suitable binder, such as an epoxy resin. While coefficient of friction of the inflatable sleeve on the grit covered surface is greatly increased, the application of the epoxy treatment increases manufacturing time and cost.

U.S. Pat. No. 4,871,179 also shows an inflatable packer which includes a tubular mandrel and an inflatable sleeve which is secured between attachment collars about the mandrel exterior. The exterior surface of the mandrel underlying the sleeve is roughened to increase the coefficient of friction between the mandrel and the sleeve. The mandrel can be roughened, as by threading the mandrel with a tooth profile. While this technique effectively increases the coefficient of friction between the mandrel exterior and the interior of the inflatable, elastomeric element, the manufacturing steps involved are again time consuming and expensive.

Accordingly, it is an object of the present invention to provide an inflatable packer having a metallic mandrel and a surrounding elastomeric sleeve with a high coefficient of friction between the mandrel and inflatable sleeve.

Another object of the invention is to provide such an inflatable packer without greatly increasing manufacturing time or expense.

SUMMARY OF THE INVENTION

The downhole device of the invention includes a metallic member having at least one external, metallic surface. The metallic member is wrapped with a tape having an outer surface and an inner surface, the outer surface containing a friction enhancing media. The tape is wound about the metallic member with the inner surface of the tape covering at least a portion of the external metallic surface, whereby the friction enhancing media is exposed on the outer surface of the tape. The tape is preferably an adhesive tape having an outer surface containing the friction enhancing media and an inner surface coated with an adhesive. The inner surface is preferably covered initially with a removeable backing. The friction enhancing media can be conveniently provided as a particulate grit.

In a preferred embodiment of the invention, an inflatable packer is provided for use in a surrounding well bore. The inflatable packer includes a tubular mandrel formed of an elongate, metallic pipe having an external metallic surface. The tubular mandrel preferably has a length of at least about 10 feet. An elastomeric sleeve surrounds the tubular mandrel having a length and opposing ends. The elastomeric sleeve is installed on the external metallic surface of the mandrel at the opposing ends thereof. The elastomeric sleeve is initially in a relaxed state in contact with the external metallic surface of the mandrel substantially along the entire length thereof but is adapted to expand radially outward in the direction of the surrounding well bore in an expanded state upon the application of a fluid pressure between the external surface of the mandrel and the elastomeric sleeve.

A tape having an inner surface and an outer surface containing a friction enhancing media is wound about the exterior of the mandrel with the inner surface of the tape covering at least a portion of the external metallic surface thereof. The friction enhancing media is exposed on the outer surface of the tape and provides an increased coefficient of friction for preventing relative longitudinal displacement of the elastomeric sleeve relative to the mandrel exterior as the packer is run into position within the well bore.

In the method of the invention, a tape is wrapped about a tubular mandrel formed of an elongate metallic pipe having an external metallic surface. The tape has an outer surface containing a friction enhancing media and an inner surface. The tape is wound about the exterior of the mandrel with the inner surface of the tape covering at least a portion of the external metallic surface thereof, whereby the friction enhancing media is exposed on the outer surface of the tape. An elastomeric sleeve is then installed about the exterior of the mandrel, the sleeve having a length and opposing ends. The opposing ends of the elastomeric sleeve are sealingly connected to the mandrel exterior, so that the elastomeric sleeve may be inflated relative to the mandrel upon the application of a cement slurry under pressure while in the well bore. The interior of the elastomeric sleeve is initially in a relaxed state in contact with the external metallic surface of the mandrel substantially along the entire length thereof. The elastomeric sleeve can be expanded radially outward in the direction of the surrounding well bore in an expanded state upon the application of a fluid pressure between the external surface of the mandrel and the elastomeric sleeve.

Additional objects, features and advantages will be apparent in the written description which follows.

DETAILED DESCRIPTION OF THE INVENTION

Figure 1:
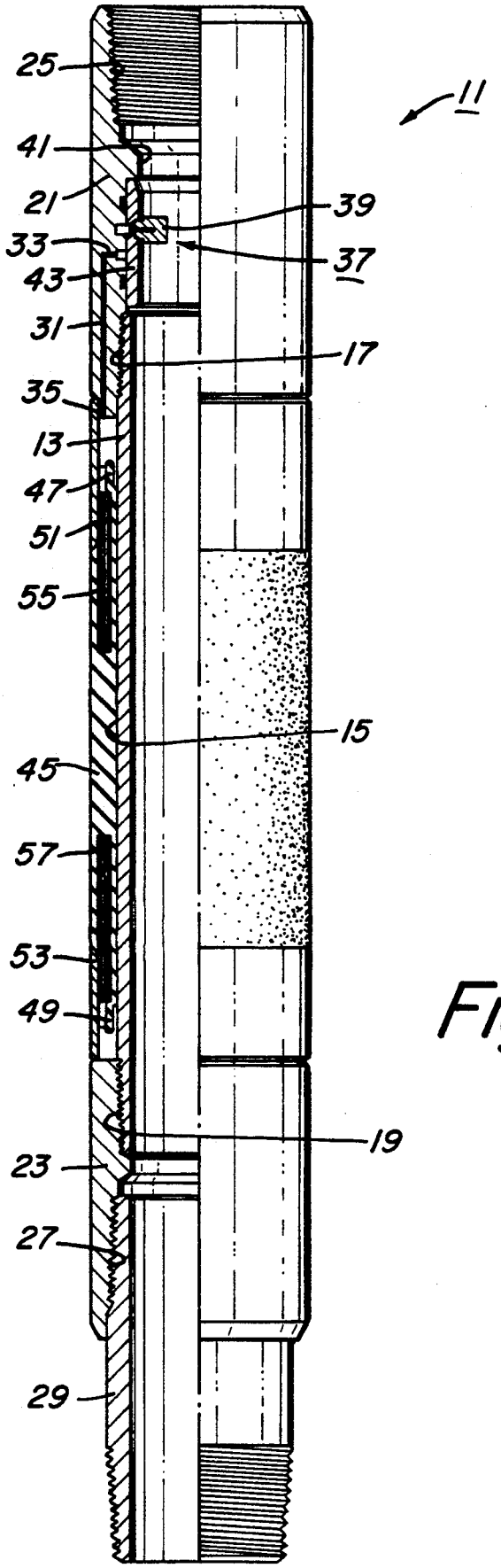
FIG. 1 is a quarter-sectional view of a downhole device for use in a well bore penetrating a subterranean formation illustrating the preferred embodiment of the present invention.

FIG. 1 shows a downhole device of the invention, designated generally as 11, which is adapted for use in a well bore penetrating a subterranean formation. In the preferred embodiment illustrated, the device is a packer which includes a metallic member 13 having at least one external, metallic surface 15. In the embodiment of FIG. 1, the metallic member 13 comprises a mandrel having upper and lower externally threaded extents 17, 19. The tubular mandrel 13 is formed of an elongate metallic pipe, such as a length of casing or the like, and typically is of a length of at least 10 feet.

The mandrel 13 is threadedly connected to a valve collar 21 at the upper extent thereof and to a connecting collar 23 at the lower respective extent. The valve collar 21 has an internally threaded extent 25 which is adapted to engage the externally threaded surface of a connecting string of pipe leading to the well surface (not shown). The connecting collar 23 is similarly provided with an internally threaded surface 27 for engaging a mating, externally threaded section of pipe 29.

The valve collar 21 includes a passageway 31 having an inlet 33 and an outlet 35 for the flow of inflating fluid therethrough. The passageway 31 includes a valve means 37 for initially preventing the flow of inflating fluid through the passageway 31, as the tool is being run within the well bore to a selected depth adjacent a producing formation. The valve means 37 in this case comprises a shearable portion 39 which is mounted internally within the bore 41 of the valve collar 21 by means of an inset sleeve 43. The shearable portion 39 can be severed in a variety of ways, including the use of a suitable running tool in order to communicate fluid pressure from within the internal bore 41 of the device with the passageway 31.

The inflatable packer 11 also includes an inflatable elastomeric sleeve 45 having a length defined between opposing ends 47, 49. The inflatable sleeve 45 is installed on the external metallic surface 15 of the mandrel by attaching the sleeve at the opposing ends thereof.

As shown in FIG. 1, the elastomeric sleeve 45 is initially in a relaxed state in contact with the external metallic surface 15 of the mandrel 11 substantially along the entire length of the sleeve 45. As will be familiar to those skilled in the art, the elastomeric sleeve 45 is adapted to expand radially outward in the direction of the surrounding well bore in an expanded state upon the application of fluid pressure between the external surface of the mandrel 15 and the interior of the elastomeric sleeve 45. Such fluid pressure is conveniently applied through the valve means 37 and passageway 31, as previously described.

As shown in FIG. 1, the elastomeric sleeve 45 is positioned about the tubular mandrel 13 by means of collars 21, 23 and associated retention portions 51, 53. The retention portions 51, 53 retain associated reinforcing elements 55, 57 which, in the embodiment of FIG. 1, comprise a plurality of longitudinally extending and overlapping ribs which are connected at one end to the retention portions 51, 53 and which are embedded within the material of the inflatable sleeve 45. As the inflatable sleeve 45 is inflated, the ribs of reinforcing elements 55, 57, separate and expand.

Figure 2:
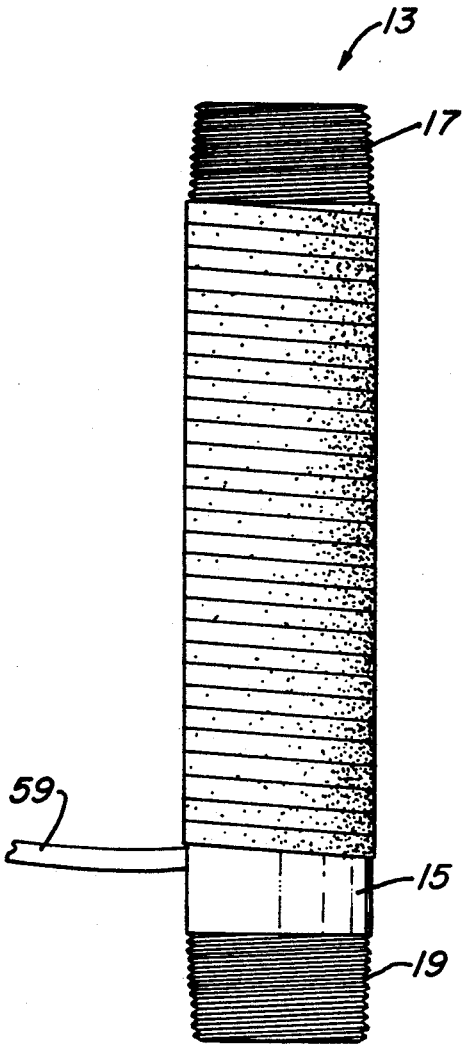
FIG. 2 is an isolated view of the tubular mandrel which is included as a part of the device of FIG. 1, showing the tape which is used to provide the enhanced friction surface thereon.
Figure 3:
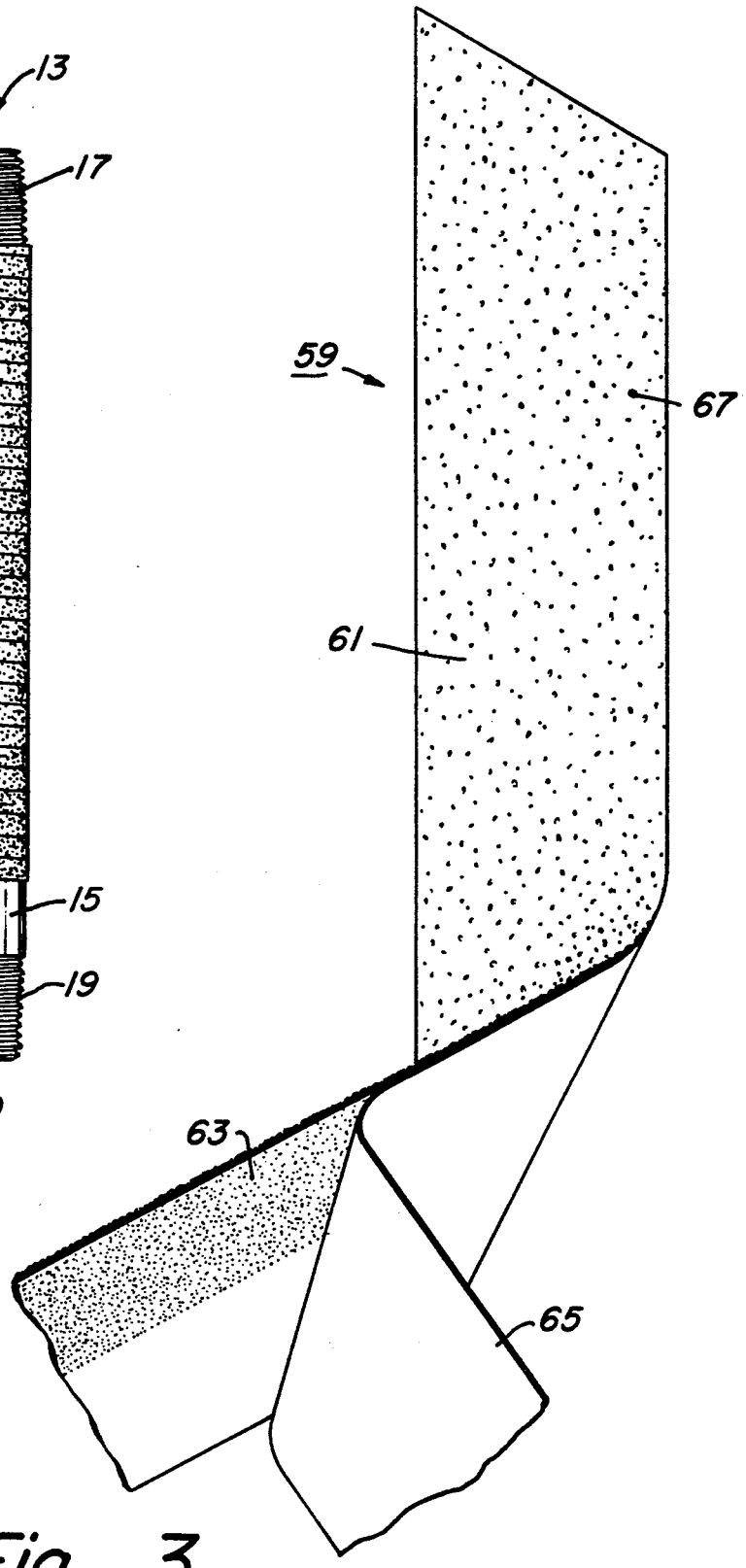
FIG. 3 is an isolated view of the tape which is used to wrap the mandrel of FIG. 2 showing the backing being separated from the adhesive surface thereof.

As described above, inflatable packers of the present type are often of a length of 10 to 40 feet or more. As such packers are run into the borehole, contact sometimes occurs between the inflatable elastomeric sleeve 45 and the surrounding borehole wall. This contact is especially likely in the case of deviated well bores. Contact between the sleeve and the borehole wall during movement causes frictional forces to be applied to the sleeve that tend to move the sleeve with respect to the mandrel. This is an undesirable situation since such movement can result in a thickening of the sleeve at the upper end and, in some cases, sticking of the packer within the surrounding borehole. FIGS. 2 and 3 illustrate the preferred mandrel and method of manufacture according to the principals of the present invention. As shown in FIG. 2, the mandrel 13 is wrapped with a tape 59 having an outer surface (61 in FIG. 3) and having an inner surface 63. The outer surface 61 of the tape 59 contains a friction enhancing media. The tape is wound about the external metallic surface 15 of the mandrel 13 with the inner surface 63 of the tape covering at least a portion of the external metallic surface, whereby the friction enhancing media is exposed on the outer surface 61 of the tape.

Preferably, the tape is an adhesive tape having an outer surface containing friction enhancing media and an inner surface coated with an adhesive, the inner surface 63 being initially covered with a removeable backing 65. The friction enhancing media is preferably a particulate grit 67 which is embedded within the outer surface 61 of the tape. The friction enhancing particulate material 67 can range from mineral, plastic, metal or other media, preferably ground to a particulate size, to enhance friction. The particulate grit 67 can be applied only to the outer surface 61 or can extend through the tape to the inner surface 63.

While, as shown in FIG. 2, the tape is preferably applied in a spiral wrap, the tape can be applied in a linear wrap or other manner. Application of the tape 59 to the external surface 15 of the mandrel 13 provides an increased coefficient of friction for preventing relative longitudinal displacement of the elastomeric sleeve 45 relative to the external surface 15 of the mandrel 13 as the packer is being run into the well bore to the desired subterranean location.

In the method of the invention, a tape is wrapped about a tubular mandrel formed of an elongate metallic pipe and having an external metallic surface 15. The tape 59 has an outer surface 61 and an inner surface 63. The outer surface 61 has a friction enhancing media applied thereto. The tape is wound about the exterior of the mandrel with the inner surface 63 of the tape covering at least a portion of the external metallic surface 15 of the mandrel. In this way, the friction enhancing media 67 is exposed on the outer surface 61 of the tape.

The elastomeric sleeve 45 is then installed about the exterior of the mandrel 13. The sleeve 45 is sealingly connected about the mandrel exterior so that the elastomeric sleeve may be inflated relative to the mandrel upon the application of a fluid slurry under pressure while in the well bore. The fluid slurry can be, for example, a cement slurry which is pumped under pressure through the bore 41 of the device from the associated pipe string leading to the well surface. Prior to pumping the fluid slurry, the shearable portion 39 of the valve means 37 if preferably sheared, as by dropping a ball through the internal bore 41, the ball being received within a valve seat (not shown) positioned at a lower location within the depending pipe string. In this way, the elastomeric sleeve 45 which is initially in the relaxed state shown in FIG. 1, is expanded radially outward in the direction of the surrounding well bore in an expanded state to form a seal with the surrounding cased or uncased well bore.

An invention has been provided with several advantages. The improved friction enhancing surface provided on the mandrel of the device of the invention prevents the elastomeric sleeve from sliding on the mandrel when friction is generated between the sleeve and the cased well bore or open hole. A wide variety of materials can be utilized for the friction enhancing media, such as plastic, metal or sand particles. The tape itself is simple in design and economical in manufacture. The application of the tape to the mandrel exterior is much simpler than prior art practices including threading or machining the external surface or the application of a friction generating material with epoxy coatings or the like.

While the invention has been shown in only one of its forms, it is not thus limited but is susceptible to various changes and modifications without departing from the spirit thereof.

What is claimed is:

1. A downhole device for use in a well bore penetrating a subterranean formation, the device comprising:

a metallic tubular mandrel having at least one external, metallic surface with means at each end thereof for attachment to additional downhole apparatus;

a tape having an outer surface and an inner surface, the outer surface containing a friction enhancing media, the tape being wound about the metallic mandrel with the inner surface of the tape covering at least a portion of the external metallic surface, whereby the friction enhancing media is exposed on the outer surface of the tape.

2. In a downhole device including a metallic tubular mandrel having at least one external, metallic surface for frictionally engaging a cooperating object when the device is used in a well bore penetrating a subterranean formation and having means at each end thereof for attachment to additional downhole apparatus the improvement comprising:

a friction enhanced surface formed on the metallic mandrel for generating friction between the external metallic surface of the metallic mandrel and the cooperating object, the friction enhanced surface comprising a tape having an outer surface and an inner surface, the outer surface containing a friction enhancing media, the tape being wound about the metallic mandrel with the inner surface of the tape covering at least a portion of the external metallic surface, whereby the friction enhancing media is exposed on the outer surface of the tape.

3. The device of claim 2, wherein the tape is an adhesive tape having an outer surface containing the friction enhancing media and an inner surface coated with an adhesive, the inner surface being initially covered with a removable backing.

4. The device of claim 3, wherein the friction enhancing media is a particulate grit.

5. An inflatable packer for use in a surrounding well bore, comprising:

a tubular mandrel formed of an elongate metallic pipe and having an external metallic surface, the tubular mandrel having a length of at least ten feet;

an elastomeric sleeve having a length and opposing ends, the elastomeric sleeve being installed on the external metallic surface of the mandrel at the opposing ends thereof, the elastomeric sleeve being initially in a relaxed state in contact with the external metallic surface of the mandrel substantially along the entire length thereof and being adapted to expand radially outward in the direction of the surrounding well bore in an expanded state upon the application of a fluid pressure between the external surface of the mandrel and the elastomeric sleeve;

a tape having an outer surface and an inner surface, the outer surface containing a friction enhancing media, the tape being wound about the exterior of the mandrel with the inner surface of the tape covering at least a portion of the external metallic surface thereof, whereby the friction enhancing media is exposed on the outer surface of the tape, the friction enhancing media providing an increased coefficient of friction for preventing relative longitudinal displacement of the elastomeric sleeve relative to the mandrel exterior as the packer is being run into the well bore.

6. The device of claim 5, wherein the tape is an adhesive tape having an outer surface containing the friction enhancing media and an inner surface containing an adhesive, the inner surface being initially covered with a removable backing.

7. The device of claim 6, wherein the friction enhancing media is a particulate grit deposited on the outer surface of the tape.

8. A method of manufacturing an inflatable packer for use in a well bore penetrating a subterranean formation, the method comprising the steps of:

wrapping a tape about a tubular mandrel formed of an elongate metallic pipe and having an external metallic surface, the tape having an outer surface and an inner surface, the outer surface containing a friction enhancing media, the tape being wound about the exterior of the mandrel with the inner surface of the tape covering at least a portion of the external metallic surface thereof, whereby the friction enhancing media is exposed on the outer surface of the tape;

installing an elastomeric sleeve having a length and opposing ends about the exterior of the mandrel;

sealingly connecting the opposing ends of the elastomeric sleeve to the mandrel exterior so that the elastomeric sleeve may be inflated relative to the mandrel upon the application of a cement slurry under pressure while in the well bore;

wherein the interior of the elastomeric sleeve is initially in a relaxed state in contact with the external metallic surface of the mandrel substantially along the entire length thereof, the elastomeric sleeve being adapted to expand radially outward in the direction of the surrounding well bore in an expanded state upon the application of a fluid pressure between the external surface of the mandrel and the elastomeric sleeve.

9. The method of claim 8, wherein the mandrel is wrapped with an adhesive tape having an outer surface containing the friction enhancing media and an inner surface containing an adhesive.

10. The device of claim 9, wherein the friction enhancing media is a particulate grit deposited on the outer surface of the tape, the inner surface of the tape being initially covered with a removable backing, the removable backing being peeled away in order that the adhesive on the inner surface of the tape might adhere to the external metallic surface of the mandrel.

* * * * *